United States Patent [19]

Brooks

[11] Patent Number: 4,573,058

[45] Date of Patent: Feb. 25, 1986

[54] CLOSED LOOP THERMAL PRINTER FOR MAINTAINING CONSTANT PRINTING ENERGY

[75] Inventor: Ralf M. Brooks, Waterloo, Canada

[73] Assignee: NCR Canada Ltd - NCR Canada LTEE, Mississauga, Canada

[21] Appl. No.: 737,836

[22] Filed: May 24, 1985

[51] Int. Cl.[4] ..... H05B 1/02

[52] U.S. Cl. ..... 346/76 PH; 346/1.1; 400/120; 219/216; 219/497

[58] Field of Search ..... 346/76 PH, 76 R, 1.1; 400/120; 250/317.1, 318; 219/120, 497

[56] References Cited

U.S. PATENT DOCUMENTS

| | | | |
|---|---|---|---|
| 3,725,898 | 4/1973 | Canton | 346/76 PH |
| 4,168,421 | 9/1979 | Ito | 346/76 PH |
| 4,500,893 | 2/1985 | Sakura et al. | 346/76 PA |

*Primary Examiner*—E. A. Goldberg
*Assistant Examiner*—A. Evans
*Attorney, Agent, or Firm*—Wilbert Hawk, Jr.; Albert L. Sessler, Jr.; George Jameson

[57] ABSTRACT

A system and method are disclosed for automatically detecting any change in average printhead resistance due to continued usage of the printhead and for automatically correcting for such resistance change in order to maintain constant printing energy. In a preferred embodiment of the invention a voltage regulator is turned off during a test mode of operation to test or measure each of the thermal elements in a thermal printhead. When the voltage regulator is turned off a constant current is sequentially allowed to flow through each of the thermal elements. The flow of constant current through an element develops a sense voltage which has an amplitude proportional to the resistance of the element being measured. The sense voltages for the elements are sequentially converted into digital signals by an analog-to-digital converter, summed together and averaged in order to develop an average printhead resistance. Each subsequent average printhead resistance after an initial average printhead resistance is compared against the initial average printhead resistance to determine whether a change in average printhead resistance has occurred. In response to a change in average printhead resistance, a processor maintains constant printing energy during a printing mode of operation by changing the pulse width of the printing pulse and/or by developing a voltage which is used to fine tune the voltage regulator to change the head voltage accordingly.

12 Claims, 6 Drawing Figures

CLOSED LOOP THERMAL PRINTER FOR MAINTAINING CONSTANT PRINTING ENERGY

CROSS REFERENCE TO RELATED PATENT APPLICATION

The commonly assigned, pending patent application Ser. No. 640,894, filed Aug. 14, 1984, for System and Method for Automatically Detecting Defective Thermal Printhead Elements, inventors Ralf M. Brooks, Arvind C. Vyas and Brian P. Connell, is related to this application.

BACKGROUND OF THE INVENTION

1. Field of the Invention.

This invention relates to thermal printing and more particularly to a system and method for automatically detecting any change in printhead resistance due to continued usage of the printhead and for automatically correcting for such resistance change in order to maintain constant printing energy.

2. Description of the Prior Art.

Many different types of thermal printers have been proposed for obtaining a substantially constant print quality or color density.

U.S. Pat. No. 4,113,391 discloses an apparatus for adjusting the pulse width of the pulses applied to printhead elements as a function of variations in supply voltage and ambient temperature.

U.S. Pat. No. 4,284,876 discloses a system which controls the pulse width of each pulse applied to a thermal element as a function of the moving speed of a thermal paper and/or the status (black/white) of the previously printed several dots so that the desired concentration or color density is obtained.

U.S. Pat. No. 4,391,535 discloses an apparatus for controlling the duty cycle or pulse width of a printing pulse for a thermal print element as a function of the estimated value of the temperature of that thermal print element.

U.S. Pat. No. 4,415,907 discloses a circuit which compares printing data for a present line with printing data for the preceding line which has already been printed, and decreases or increases the pulse widths of the printing pulses to the thermal resistor elements for the present line as a function of whether or not the elements in the print line were heated during the previous line.

U.S. Pat. No. 4,434,354 discloses a thermal printer which adjusts the pulse width as a function of the amplitude of a power supply voltage in order to maintain a constant record density.

None of the above-cited, prior art thermal printers adjusts the head voltage and/or pulse width of a printing pulse as a function of a change in the thermal printhead resistance. As a result, none of the above-cited, prior art thermal printers provides for compensating for resistance changes in the thermal printhead as a result of repeated use.

SUMMARY OF THE INVENTION

Briefly, a system and method therefor is provided for automatically detecting any change in average printhead resistance due to continued usage of the printhead and for automatically correcting for such resistance change in order to maintain constant printing energy. In a preferred embodiment of the invention a voltage regulator is turned off during a test mode of operation to test or measure each of the thermal elements in a thermal printhead. When the voltage regulator is turned off a constant current is sequentially allowed to flow through each of the thermal elements. The flow of constant current through an element develops a sense voltage which has an amplitude proportional to the resistance of the element being measured. The sense voltages for the elements are sequentially converted into digital signals by an analog-to-digital converter, summed together and averaged in order to develop an average printhead resistance. Each subsequent average printhead resistance after an initial average printhead resistance is compared against the initial average printhead resistance to determine whether a change in average printhead resistance has occurred. In response to a change in average printhead resistance a processor maintains constant printing energy during a printing mode of operation by changing the pulse width of the printing pulse and/or by developing a voltage which is used to fine tune the voltage regulator to change the head voltage accordingly.

BRIEF DESCRIPTION OF THE DRAWINGS

Various objects, features and advantages of the invention, as well as the invention itself, will become more apparent to those skilled in the art in the light of the following detailed description taken in consideration with the accompanying drawings wherein like reference numerals indicate like or corresponding parts throughout the several views and wherein.

DESCRIPTION OF THE PREFERRED EMBODIMENT

Although the compensation or correction techniques for the thermal printer of this invention will be described in relation to its application in a thermal line printer, it should be realized that the techniques of the invention could be utilized in other applications. For example, the compensation techniques of the invention can also be utilized in a serial thermal printhead.

Figure 1:
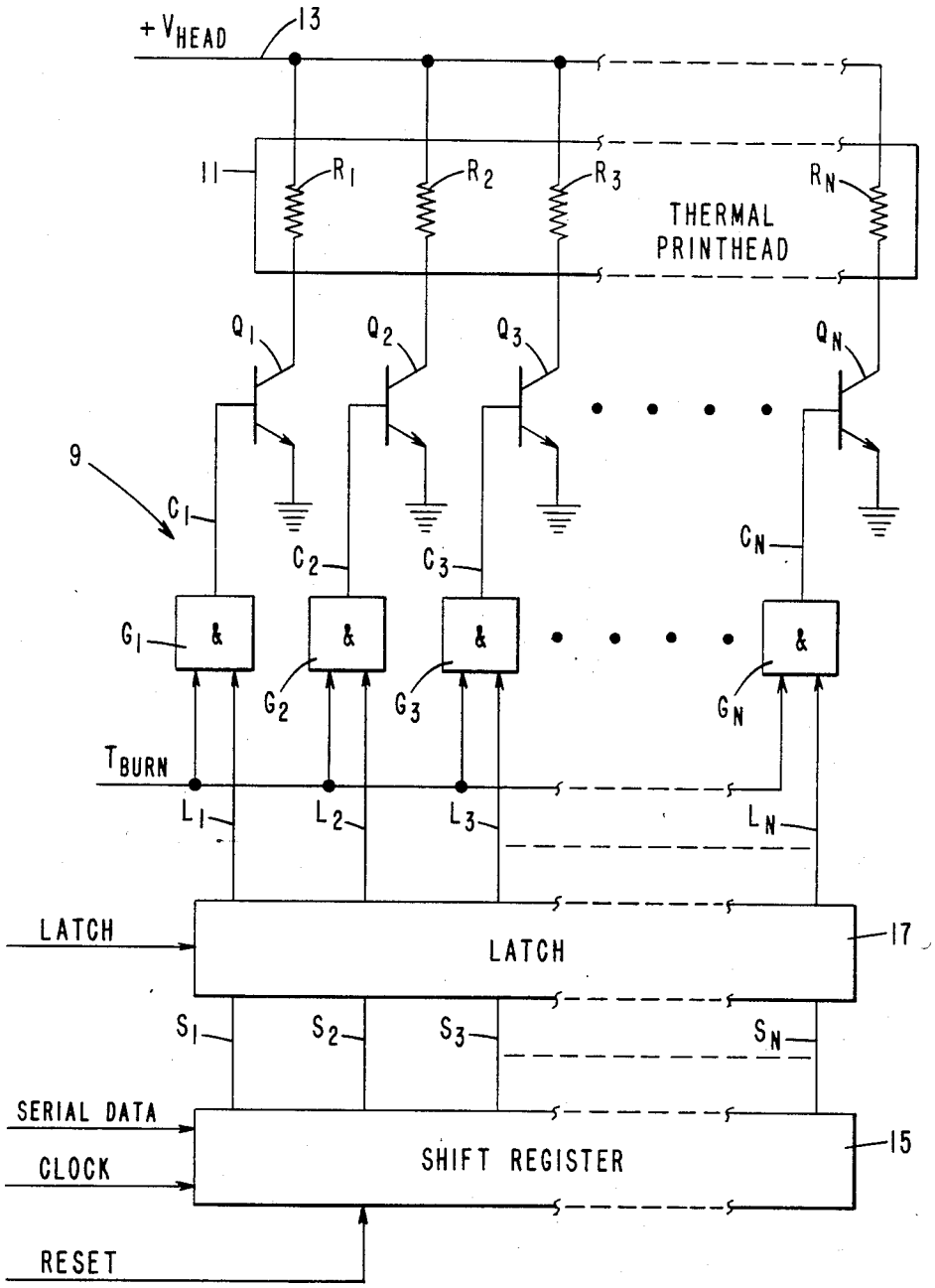
FIG. 1 PRIOR ART
FIG. 1 is a schematic block diagram of a prior art or conventional thermal line printer.

Referring now to the drawings, FIG. 1 discloses an example of a prior art thermal line printer 9. In the thermal line printer 9 of FIG. 1, thermal printhead or thermal resistive elements or heater elements $R_1$–$R_N$ are positioned in line on an insulated ceramic or glass substrate (not shown) of a thermal printhead 11. As shown in FIG. 1, upper terminals of the elements $R_1$–$R_{RN}$ are commonly connected to a positive voltage source (not shown) via a $+V_{HEAD}$ line 13, while lower terminals of the elements $R_1$–$R_N$ are respectively connected to the collectors of NPN driver transistors $Q_1$–$Q_N$, whose emitters are grounded. These transistors $Q_1$–$Q_N$ are selectively turned on (to be explained) by high or 1 state signals applied to their bases in order to ground preselected ones of the lower terminals of associated ones of the elements $R_1$–$R_N$ to thermally print a dot line of information. Each of the transistors $Q_1$–$Q_N$ that is turned on allows current to flow through its associated one of the thermal resistive elements $R_1$–$R_N$ for the length of time $T_{BURN}$ that that transistor is turned on. The resulting $I^2Rt$ energy (typically 2–3 millijoules per element) causes heat transfer to either a donor thermal transfer ribbon (not shown) to affect ink transfer to plain paper or causes a recipient thermal paper (not shown), when used, to develop.

In the operation of the thermal line printer of FIG. 1, a stream of serial data of N (binary) bits in length is shifted into a shift register 15 by CLOCK pulses until N bits are stored in the register 15. This shift register 15 is comprised of a sequence of N flip-flops (not shown) which are all reset to 0 state outputs by a RESET pulse before the stream of N bits of serial data is stored therein. These N bits of data in register 15 represent the next line of data that is to be thermally printed.

The N bits of data stored in register 15 are supplied in parallel over lines $S_1$–$S_N$ to associated inputs of latch 17. When the N bits stored in the register 15 have stabilized, a LATCH signal enables latch 17 to simultaneously store in parallel the N bits of data from register 15.

Once the N bits of data from register 15 are stored in latch 17, another line of N bits of serial data can be sequentially clocked into shift register 15.

The N bits of data stored in latch 17 are respectively applied in parallel over lines $L_1$–$L_N$ to first inputs of AND gates $G_1$–$G_N$. These N bits of data determine which ones of the thermal resistive elements $R_1$–$R_N$ will be activated when a high $T_{BURN}$ pulse is commonly applied to second inputs of the AND gates $G_1$–$G_N$. More specifically, only those of the lines $L_{1-LN}$ that are high (logical 1) will activate their associated ones of the elements $R_1$–$R_N$ to thermally print when the $T_{BURN}$ pulse is high. For example, if the binary bit on line $L_3$ is high, it will be ANDed in AND gate $G_3$ with the common $T_{BURN}$ pulse and turn on transistor $Q_3$, causing current to flow through thermal resistive element $R_3$ for the length of time, t, controlled by the width of the $T_{BURN}$ pulse. The resulting $I^2Rt$ energy dissipated by element $R_3$ causes a dot to be thermally printed at that $R_3$ location on the recording medium or document being utilized.

A major problem with the prior art thermal line printer of FIG. 1 is that the resistances of the thermal printhead elements $R_1$–$R_N$ tend to change in value as a function of the number of times electrical current is passed through them, generally due to thermal oxidation of the resistor layer.

Figure 2:
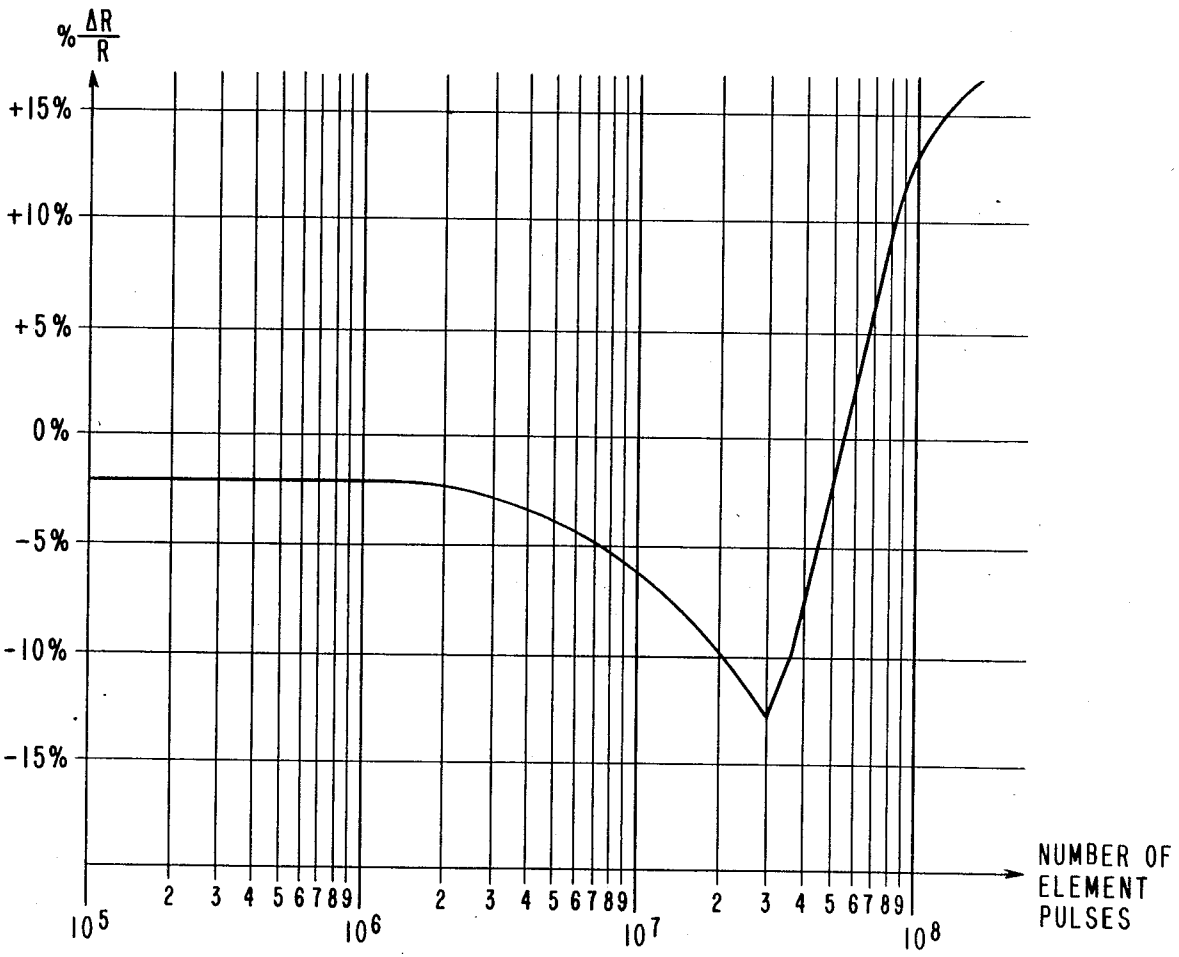
FIG. 2 shows a plot of percent change in resistance of a representative one of the printhead elements of FIG. 1, or $\Delta R/R$ % drift, versus the number of times that that printhead element has been pulsed.

FIG. 2 shows a typical plot of percent (%) change in resistance of a representative one of the printhead elements $R_1$–$R_N$, or $\Delta R/R$ % drift, versus the number of times that the printhead element has been pulsed, starting after $1\times10^5$ pulses have been previously applied to that element. Note that as the number of pulses increases, the thermal printhead resistance can decrease in value by about 12.5% after $3\times10^7$ pulses and then start to rapidly increase in value.

Returning now to FIG. 1, it should be noted that the illustrated prior art thermal line printer 9 is an "open loop" arrangement, with the common $+V_{HEAD}$ voltage being fixed in amplitude and the common $T_{BURN}$ pulse being fixed in duration. That is, throughout the life of the printhead 11 the values of $+V_{HEAD}$ and $T_{BURN}$ remain constant, since there is no quantitative (or feedback) means of detecting changes in the resistances of the elements $R_1$–$R_N$.

For any given one of the printhead elements R1-RN:

$$P = \frac{(V_{HEAD})^2}{R} \tag{1}$$

and $$E = \frac{(V_{HEAD})^2}{R} \cdot T_{BURN} \tag{2}$$

where

R = resistance of that given element,

P = watts dissipated by that given element,

E = energy (in millijoules) emitted by that given element, and $T_{BURN}$ = time in milliseconds that electrical current is passed through that given element.

Thus, during the life of the printhead 11 of FIG. 1, as the resistance of a given one of the elements $R_1$–$R_N$ changes (as shown in FIG. 2), the power dissipated by that given element and the energy emitted by that given element will also change, respectively following the inverse relationships shown in equations (1) and (2) above. For example, during the later part of the life of the printhead 11, as the resistance of that given element is increasing (as shown in FIG. 2) the energy emitted by that given element should be decreasing proportionately.

Figure 3:
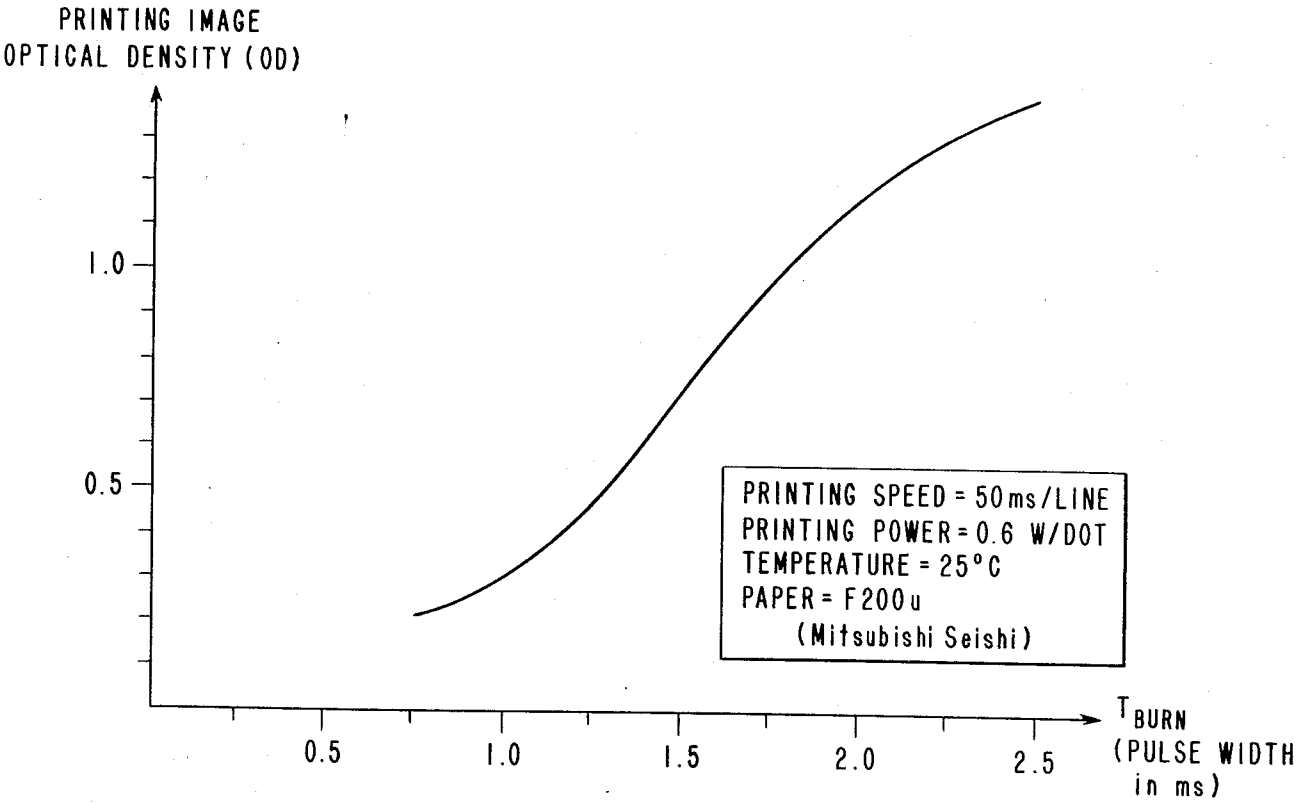
FIG. 3 shows a plot of printing image density versus the pulse width of the $T_{BURN}$ pulse.

FIG. 3 shows a plot of the printing image optical density, OD, of a printed image (not shown), as measured by a densitometer (not shown), versus the pulse width in milliseconds (ms) of the $T_{BURN}$ pulse that is applied to the printhead elements $R_1$–$R_N$. The term "OD" can be defined as the degree of contrast between white paper and the print on that white paper (i.e., darkness of print). Note that as the pulse width of $T_{BURN}$ is increased, the optical density of the printed image becomes greater, as might be expected from equation (2).

Figure 4:
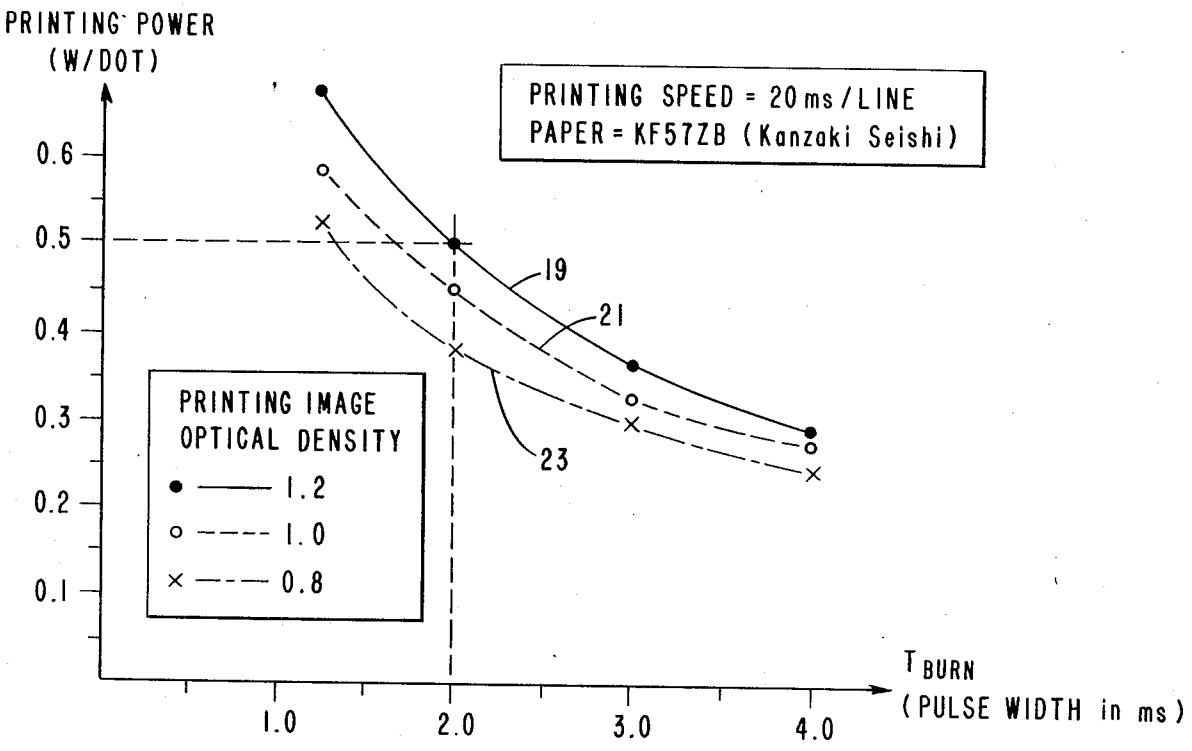
FIG. 4 shows the relationship between printing power versus the pulse width of the $T_{BURN}$ pulse to obtain constant printing image density.

FIG. 4 shows the relationship between printing power (watts per dot) and the pulse width in milliseconds of the $T_{BURN}$ pulse in order to obtain constant printing image density. Three different plots 19, 21 and 23 of printing power versus $T_{BURN}$ are shown for obtaining constant printing image optical densities of 1.2, 1.0 and 0.8, respectively. Using the data contained in the plots 19, 21 and 23, it can be seen that, for a fixed $T_{BURN}$ pulse having an exemplary pulse width of 2.0 milliseconds, the printing image density decreases as the printing power decreases. For example, when the printing power decreases from 0.5 watts/dot to approximately 0.37 watts/dot, the printing image optical density decreases from 1.2 (on plot 19) to 0.8 (on plot 23). Such a decrease in printing power would occur with an increase in resistance, as indicated in equation (1). A decrease in printing image optical density, caused by a decrease in printing power, is very undesirable in those situations where quality print is wanted at all times and print "fading" cannot be tolerated.

Figure 5:
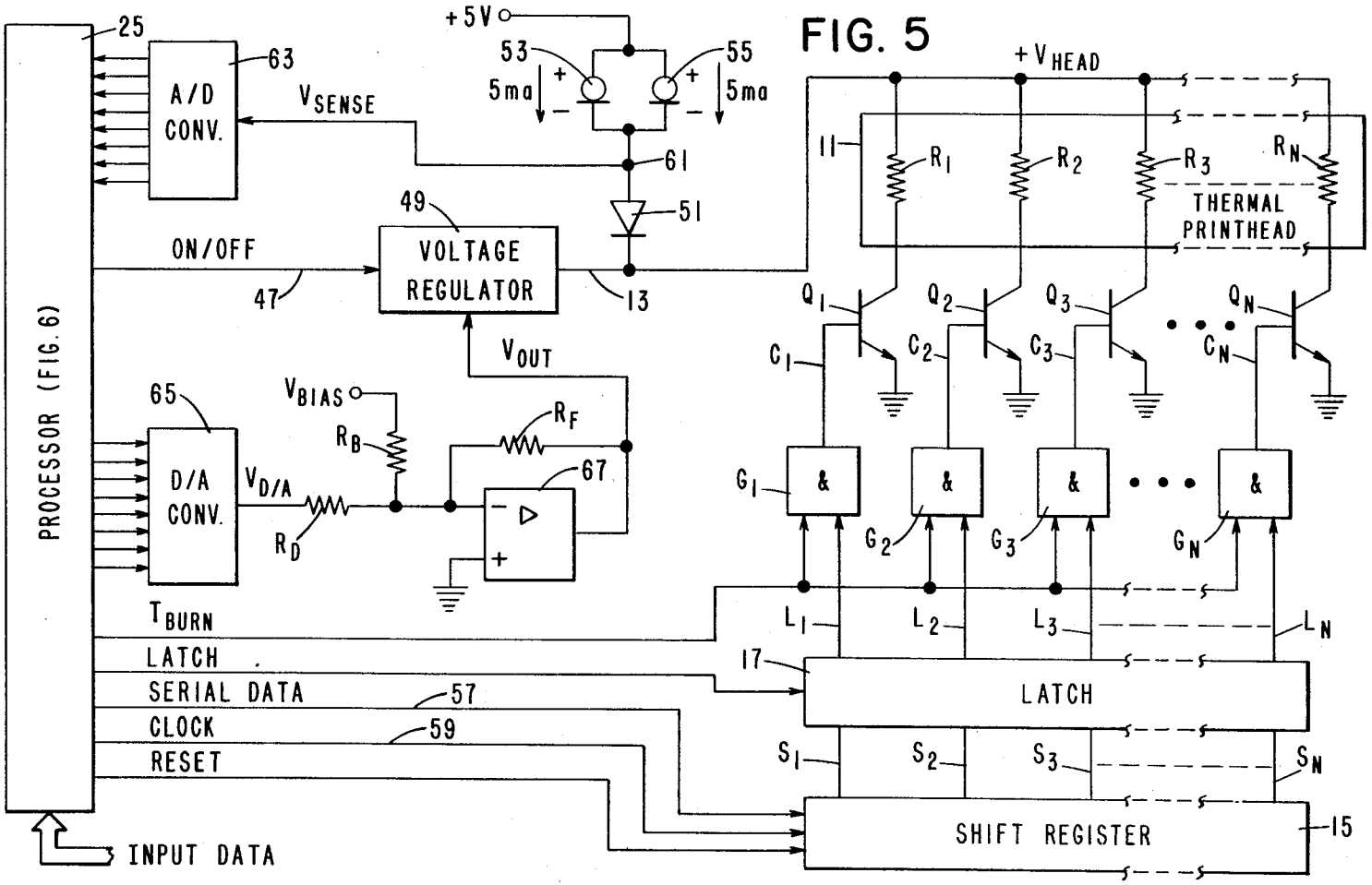
FIG. 5 is a schematic block diagram of a preferred embodiment of the invention.

Referring now to FIG. 5, a preferred embodiment of the closed loop thermal printer of the invention is disclosed for minimizing the problems discussed in relation to the conventional thermal printer of FIG. 1. The thermal printer of FIG. 5 provides for the automatic calculation of the average element resistance and the automatic control of the burn time duration and/or head voltage amplitude, as discussed below.

For purposes of this description, the thermal printer of FIG. 5 includes the shift register 15, lines $S_1$–$S_N$, latch 17, lines $L_1$–$L_N$, AND gates $G_1$–$G_N$, lines $C_1$–$C_N$, driver transistors $Q_1$–$Q_N$, thermal printhead 11 (with thermal resistive or heater elements $R_1$–$R_N$) and the $+V_{HEAD}$ line 13 of FIG. 1. These above-identified structural elements of FIG. 5 are similar in structure, structural interconnection and operation to those of the correspondingly numbered structural elements described in relation to FIG. 1 and, hence, require no further description.

Figure 6:
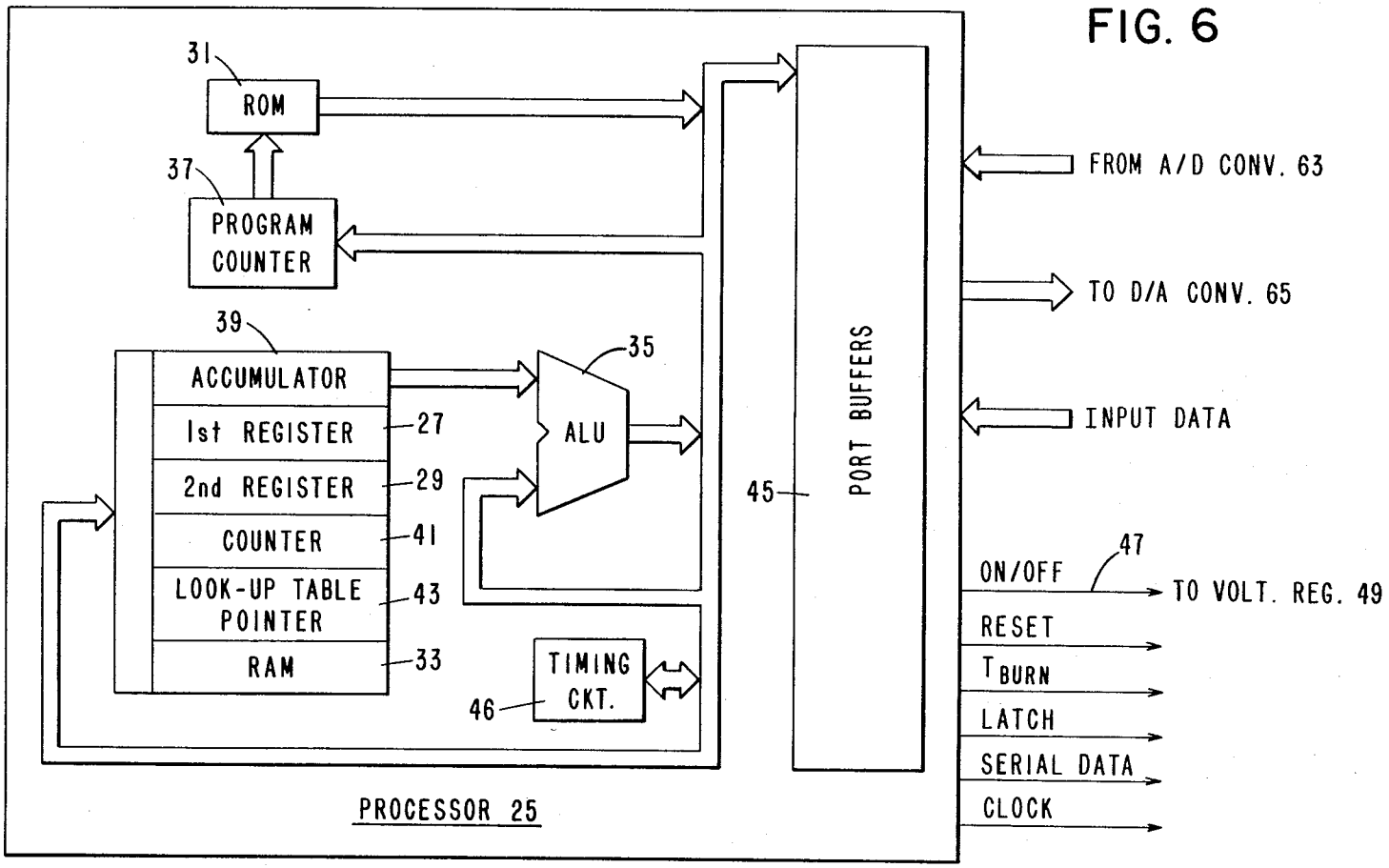
FIG. 6 is a schematic block diagram of the processor of FIG. 5.

The system of FIG. 5 includes a processor 25, which is shown in more detail in FIG. 6, for selectively controlling the operation of the system. The processor 25 can be a computer, microprocessor or any other suitable computing device. For purposes of this description, the processor 25 is an 8051 microprocessor manufactured by Intel Corporation, Santa Clara, Calif. As shown in FIG. 6, the microprocessor or processor 25 includes a first register 27, a second register 29, a read only memory (ROM) 31 which stores the software program to be performed, a random access memory (RAM) 33 for temporarily storing data, and an arithmetic logic unit (ALU) 35, controlled by the software program in the ROM 31, for performing arithmetic operations and generating signals to control the operations of the processor 25. In addition, the processor 25 includes additional circuits, such as a program counter 37 controlled by the ALU 35 for accessing the main program and various subroutines in the ROM 31, an accumulator 39, a counter 41, a lookup table pointer 43, port buffers 45 and a timing circuit 46 to develop a system CLOCK and other internal timing signals (not shown) for the processor 25.

The system of FIG. 5 has two phases of operation. In the first phase of operation, the thermal resistive elements $R_1$–$R_N$ are automatically periodically measured to determine an average printhead resistance which is compared with an initially calculated average printhead resistance. In the second mode of operation any change in average printhead resistance is compensated for to maintain a substantially constant printing energy by automatically controlling the duration of $T_{BURN}$ and/or the amplitude of $V_{HEAD}$ as an inverse function of the extent of the change in the average printhead resistance. These two phases of operation will now be discussed.

AVERAGE PRINTHEAD RESISTANCE COMPUTATION

Initially (prior to the initial time that the printhead 11 is put in service), the processor 25 applies an OFF signal to ON/OFF line 47 to turn off a voltage regulator 49, thus preventing the voltage regulator 49 from applying a +20 V regulated voltage to the $V_{HEAD}$ line 13 and to the thermal printhead resistive elements $R_1$–$R_N$. The turning off of the voltage regulator 49 forward biases a diode 51, which has its cathode coupled to the $V_{HEAD}$ line 13 and its anode coupled through two parallel-connected field effect current regulator diodes 53 and 55 to a +5 V potential. The diode 51 may be, for example, a germanium diode. Preferably, the diodes 53 and 55 are 1N5314 field effect current regulator diodes manufactured by Motorola, Inc., with each diode having a nominal constant current of 5 milliamperes (ma). Thus, the parallel combination of diodes 53 and 55 can produce a total constant current of 10 ma.

With diode 51 forward biased, the 10 ma of constant current from current regulator diodes 53 and 55 flows through the diode 51 and through a selected one of the thermal elements $R_1$–$R_N$ and its associated one of the driver transistors $Q_1$–$Q_N$ to ground. Any given one of the thermal resistive elements $R_1$–$R_N$ can be controllably selected by selectively enabling its associated one of the driver transistors $Q_1$–$Q_N$.

For measurement purposes, only one of the thermal printhead elements $R_1$–$R_N$ is activated or turned on at any given time. This is accomplished by the processor 25 outputting serial data onto a SERIAL DATA line 57 and associated clock pulses onto a CLOCK line 59. The serial data contains only one "1" state bit which is associated in position within the serial data to the position of the element in the printhead 11 that is to be measured, with the remaining N-1 bits in the serial data being "0" state bits.

The serial data containing only one "1" state bit is clocked from the line 57 into the shift register 15 by means of the clock pulses on line 59. The position of this "1" state bit in the serial data in register 15 corresponds to the position of the element in the printhead that is to be tested. This "1" state bit in the register 15 is latched into latch 17 by a LATCH pulse. That latched "1" state bit, which is now at an associated one of the outputs $L_1$–$L_N$ of latch 17, is then used to enable the associated one of AND gates $G_1$–$G_N$, at the time of a $T_{BURN}$ pulse from the processor 25, to activate the desired one of the elements $R_1$–$R_N$ by turning on the associated one of the transistors $Q_1$–$Q_N$. For example, if element $R_1$ is to be measured, only the last bit clocked into the register 15 would be a "1" state bit. This "1" state bit would be applied via line $S_1$ to latch 17 and latched therein by a LATCH pulse. This "1" state bit in latch 17 would be applied via line $L_1$ to enable AND gate $G_1$ at the time of the $T_{BURN}$ pulse to turn on transistor $Q_1$ and thereby activate element $R_1$ to be measured.

It will be recalled that, when diode 51 is forward biased, the 10 ma of constant current from the current regulator diodes 53 and 55 flows through the diode 51 and through the selected one of the thermal elements $R_1$–$R_N$ and its associated one of the driver transistors $Q_1$–$Q_N$ to ground. This 10 ma of constant current causes a voltage, $V_{SENSE}$, to be developed at the junction 61 of the diode 51 and the parallel-connected diodes 53 and 55.

The amplitude of $V_{SENSE}$ is substantially dependent upon the amplitude of the voltage drop across the selected one of the elements $R_1$–$R_N$, which in turn is dependent upon the resistance of the selected one of the elements $R_1$–$R_N$. More specifically, the amplitude of $V_{SENSE}$ can be determined by the equation $$V_{SENSE}=(0.01\text{A})\cdot R_{TPH}+V_{D51}+V_{QTPH} \quad (3)$$

where 0.01A = 10 ma $R_{TPH}$ = resistance of whichever thermal printhead element has been selected for measurement $V_{D51}$ = voltage drop across the germanium diode 51 (typically 0.2 to 0.3 V)

$V_{QTPH}$ = voltage drop across whichever saturated driver transistor is turned on by the "1" state bit (typically 0.2 V)

Thus, an initial reference $V_{SENSE}$ value can be determined for each of the thermal elements $R_1$–$R_N$ in the thermal printhead 11. Each initial reference $V_{SENSE}$ value is sequentially digitized by an analog-to-digital converter (A/D Conv.) 63 before being applied to the processor 25. These initial reference $V_{SENSE}$ values effectively correspond to the respective initial resistances of the thermal elements $R_1$–$R_N$.

The sequence of initial reference $V_{SENSE}$ values are applied through port buffers 45 (FIG. 6) and operated on by accumulator 39 (FIG. 6). Once all of the initial reference $V_{SENSE}$ values for the elements $R_1$–$R_N$ have been stored, the total accumulated value or sum is divided in the ALU 35 by the quantity N from the ROM 31 to derive an initial average resistance value for the N elements $R_1$–$R_N$ in the printhead 11. This initial average resistance value is then stored in the RAM 33 of the processor 25. It should be noted that the processor 25 is preferably operated with a battery backup (not shown) to prevent the loss of the initial average resistance value and other data in power down situations. In an alternative arrangement, the initial average resistance value could be stored in an off-board RAM (not shown) which has a battery backup. Such battery backup arrangements are well known to those skilled in the art and, hence, require no further explanation.

After the thermal printhead 11 is put into operation or service, the resistances of the elements $R_1$–$R_N$ change with time of operation. As a consequence, a new average resistance value for the printhead elements $R_1$–$R_N$ is periodically determined and then stored temporarily in the first register 27 (FIG. 6). A new average resistance value from the register 27 (FIG. 6) is compared in the ALU 35 (FIG. 6) with the initial average resistance value from the RAM 33 to determine the change from the initial average resistance value of the elements $R_1$–$R_N$. It is the change in these average resistance values that will be used to determine the corresponding change in the pulse width of $T_{BURN}$ and/or the amplitude of $V_{HEAD}$.

It should be noted at this time that, in an alternative arrangement, the printhead elements $R_1$–$R_N$ could be divided into a plurality of groups of elements of, for example, 2 or 3 elements per group for measurement purposes. The effective resistance values of the plurality of groups would be respectively measured and summed with each other, before an average resistance value for the printhead 11 is determined. However, such a grouping arrangement would not work if each of the groups were so large in size that each measurement of a group would yield results too low to monitor changes. For example, to take the extreme case of only one group, if all of the elements $R_1$–$R_N$ were turned on simultaneously to determine an average value, the current through each of the elements $R_1$–$R_N$ would be too low and, hence, $V_{SENSE}$ would be too low to monitor changes. It should be noted that if, during the course of measuring the individual resistances of the elements $R_1$–$R_N$, it is determined that one of the elements has failed (by having a resistance that is 15 percent greater than its initial resistance value), then the resistance value of that failed element will not be included in the determination of a new average resistance value $R_{NEW}$ and the total number of elements, N, used in the calculation will be decreased by one.

CORRECTION MODE TO MAINTAIN CONSTANT PRINTING POWER

Once a change in average resistance to a new value, $R_{NEW}$, is determined by the ALU 35 (FIG. 6), in order to maintain E (energy emitted by a given one of the elements $R_1$–$R_N$) constant a correction can be made to $V_{HEAD}$, as given by the equation $$V_{HEAD}(\text{NEW}) = \sqrt{\frac{E \cdot R_{NEW}}{T_{BURN}}} \tag{4}$$

where $T_{BURN}$ is held constant, or a correction can be made to $T_{BURN}$, as given by the equation $$T_{BURN}(\text{NEW}) = \frac{E \cdot R_{NEW}}{V_{HEAD}^2} \tag{5}$$

where $V_{HEAD}$ is held constant.

In a similar manner, both $V_{HEAD}$ and $T_{BURN}$ can be changed to achieve a constant value of E. However, when printing speed is important it is more advantageous to only change $T_{BURN}$ when $R_{NEW}$ is less than the initial average resistance value and to only change $V_{HEAD}$ when $R_{NEW}$ is greater than the initial average resistance value, since any increase in the pulse width of $T_{BURN}$ will definitely slow down a printing operation.

1. CORRECTION OF $V_{HEAD}$

Control of the head voltage, $V_{HEAD}$, according to equation (4) may be accomplished by an 8-bit digital-to-analog (D/A) converter 65 coupled to a port (not shown) in the processor 25. The output of this D/A converter 65 can be a control voltage $V_{D/A}$ which is applied through a resistor $R_D$ to the inverting input of an operational amplifier 67. The inverting input of the amplifier 67 is also biased through a resistor $R_B$ by a reference bias voltage $V_{BIAS}$. Thus, the serially-connected resistors $R_D$ and $R_B$, which are connected between $V_{D/A}$ and $V_{BIAS}$, form a voltage divider for controlling, as a function of the amplitude of $V_{D/A}$, the amplitude of the control signal applied to the amplifier 67. A feedback resistor $R_F$ is connected between the output and inverting input of the amplifier 67.

The output voltage, $V_{OUT}$, of the amplifier 67 is applied to the voltage regulator 49 to control the amplitude of the voltage output, $V_{HEAD}$, of the voltage regulator 49. $V_{OUT}$ is determined by the equation $$V_{OUT} = -R_F\left[\frac{V_{D/A}}{R_D} + \frac{V_{BIAS}}{R_B}\right] \tag{6}$$

In operation, $V_{BIAS}$ is the dominant component to $V_{OUT}$, with $V_{D/A}$ being the "fine tune" control voltage with 256 discrete levels ($2^8$). Thus, small changes in average printhead resistance can be compensated for by a 1 or 2 bit change in $V_{D/A}$.

2. CORRECTION OF $T_{BURN}$

Control of the burn time, $T_{BURN}$, to compensate for changes in the average element resistance, according to equation 5, can be easily accomplished by signal updates to the timing circuit 46 of the processor 25 to change the duty cycle of the $T_{BURN}$ pulse.

More specifically, the burn time, $T_{BURN}$ (NEW), is computed according to equation (5). The value E in equation (5) is a constant value which is part of the program stored in the ROM 31 (FIG. 6). In an alternative arrangement, the value E could be stored in the RAM 33 (FIG. 6). The new average resistance value, $R_{NEW}$, is calculated (as discussed above) and stored in the register 27 (FIG. 6). $V_{HEAD}^2$ is calculated in the processor 25 as a function of the amplitude of the digital signal applied from the processor 25 to the D/A converter 65 (FIG. 5), before being stored in the register 29 (FIG. 6). The ALU 35 (FIG. 6) develops a digital value representative of the time duration of the $T_{BURN}$ pulse by multiplying the value E from the ROM 31 by the value $R_{NEW}$ from the register 27 before dividing the resultant product of E and $R_{NEW}$ by the value $V_{HEAD}^2$ from the register 29.

These digital value representative of the time duration of the $T_{BURN}$ pulse is stored in a timing register (not shown) in the timing circuit 46. Timing circuit 46 also includes a clock generator (not shown) and count down circuits (not shown) for supplying proper timing signals and clocks to the system of FIG. 5. The digital value stored in the timing register of timing circuit 46 determines the duration of the $T_{BURN}$ pulse being applied from the timing circuit 46 to the gates $G_1$–$G_N$ (FIG. 5).

The invention thus provides a closed loop system and method for automatically monitoring resistance changes found in commercial thermal printheads as a result of repeated use. The system then periodically calculates an average effective resistance value for the printhead elements. This average effective resistance value is used to compute a new printhead voltage setting and/or a new burn time, such that over the life of the thermal printhead the average energy pulse emitted from the printhead elements is constant. This will lead to consistent, repeatable print quality without the fading "light print" problems which characterize conventional, open-loop control thermal printhead systems. In addition, a longer printhead life will result from maintaining a constant average energy pulse for the thermal printhead heating elements.

While the salient features of the invention have been illustrated and described, it should be readily apparent to those skilled in the art that many changes and modifications can be made in the system and method of the invention presented without departing from the spirit and true scope of the invention. Accordingly, the present invention should be considered as encompassing all such changes and modifications of the invention that fall within the broad scope of the invention as defined by the appended claims.

I claim:

1. A thermal printing system comprising:

first means for producing serial character data and enabling pulses during a first mode of operation and for producing a control signal, serial test data and said enabling pulses during a second mode of operation;

thermal printing means for thermally printing characters, said thermal printing means including: a linear array of thermal elements; second means being responsive to said serial character data and said enabling pulses for selectively applying driving pulses corresponding to said character data to said thermal elements during the first mode of operation and being further responsive to said serial test data and said enabling pulses for selectively applying driving pulses corresponding to said serial test data to said thermal elements during the second mode of operation; and third means being responsive to the absence of said control signal for applying a head voltage to said thermal elements to enable said thermal elements to be selectively energized to thermally print characters in accordance with said serial character data and being further responsive to the presence of said control signal for enabling said thermal elements to be selectively measured during each second mode of operation;

fourth means coupled to said thermal elements being responsive to the absence of said head voltage for selectively developing associated measurement signals for said thermal elements during each second mode of operation, said measurement signals having amplitudes representative of the respective resistances of said thermal elements;

fifth means responsive to the measurement signals for developing an average value representative of the average resistance of said thermal elements during each second mode of operation;

sixth means for comparing an initial average value against each subsequent average value to develop a correction signal representative of the change in average value during each subsequent second mode of operation; and seventh means coupled to said thermal printing means being responsive to said correction signal for causing said thermal printing means to maintain a consistent print quality of printed characters during any given first mode of operation.

2. The system of claim 1 wherein said correction signal is an enabling signal which has been changed in width as a function of the change in average value and wherein:

said seventh means comprises means for applying each said correction signal to said second means to enable said second means to cause said thermal elements to be energized for a sufficient duration of time during each first mode of operation to maintain consistent print quality of printed characters.

3. The system of claim 1 wherein said seventh means comprises:

means responsive to said correction signal for causing said third means to adjust the amplitude of said head voltage to maintain a consistent print quality of printed characters during any given first mode of operation.

4. The system of claim 3 wherein said correction signal is a digital signal and wherein said causing means comprises:

a digital-to-analog converter for converting the digital correction signal to an analog correction signal; and amplifier means responsive to the analog correction signal for producing an output signal to cause said third means to adjust the amplitude of said head voltage to maintain a consistent print quality of printed characters during any given first mode of operation.

5. The system of claim 3 wherein:

said first means is responsive to the correction signal for changing the pulse width of each of said enabling pulses as a function of the amplitude of said correction signal.

6. The system of claim 1 wherein:

said seventh means comprises means responsive to said correction signal for causing said third means to adjust the amplitude of said head voltage as a function of the amplitude of said correction signal; and said first means is responsive to the correction signal for changing the pulse width of each of said enabling pulses as a function of the amplitude of said correction signal;

said seventh and first means cooperating to respectively change the amplitude of said head voltage and pulse width of each enabling pulse in order to cause said thermal printing means to maintain a consistent print quality of printed characters during any given first mode of operation.

7. The system of claim 1 wherein said first means is a processor.

8. The system of claim 1 wherein said fourth means comprises:

a source of constant current;

a gate responsive to the absence of said head voltage for allowing constant current to flow through any given thermal element enabled by a driving pulse in order to develop an analog measurement signal for said given thermal element; and means for converting said analog measurement signal to a digital measurement signal before applying said digital measurement signal to said fifth means.

9. A method for automatically detecting and correcting for any change in printhead resistance of a thermal printer in order to maintain constant printing energy, said method comprising the steps of:

producing serial character data during a first mode of operation and serial test data during a second mode of operation;

selectively applying driving pulses corresponding to the serial character data to thermal elements of the thermal printer during each first mode of operation and driving pulses corresponding to the serial test data to the thermal elements during each second mode of operation;

applying a head voltage to the thermal elements during each first mode of operation to enable the thermal elements to print characters in accordance with the serial character data;

preventing the head voltage from being applied to the thermal elements during each second mode of operation;

selectively developing measurement signals having amplitudes representative of the respective resistances of the thermal elements during each second mode of operation;

generating an average value representative of the average resistance of the thermal elements during each second mode of operation;

comparing an initial average value against each subsequent average value to develop a correction signal representative of the change in average value during each subsequent second mode of operation; and utilizing the correction signal to cause the thermal printer to maintain a consistent print quality of printed characters during any given first mode of operation.

10. The method of claim 9 wherein said utilizing step includes the stop of:

changing the pulse width of each of the driving pulses as a function of the amplitude of the correction siganl.

11. The method of claim 9 wherein said utilizing step includes the step of:

causing the amplitude of the head voltage to be changed as a function of the amplitude of the correction signal.

12. The method of claim 9 wherein said utilizing step includes the steps of:

changing the pulse width of each of the driving pulses as a function of the amplitude of the correction signal; and causing the amplitude of the head voltage to be changed as a function of the amplitude of the correction signal.

* * * * *